US011910978B2

(12) United States Patent
Wansley

(10) Patent No.: US 11,910,978 B2
(45) Date of Patent: Feb. 27, 2024

(54) GLOVED WASH MITT APPARATUS

(71) Applicant: Karita Wansley, Nashville, TN (US)

(72) Inventor: Karita Wansley, Nashville, TN (US)

( * ) Notice: Subject to any disclaimer, the term of this patent is extended or adjusted under 35 U.S.C. 154(b) by 184 days.

(21) Appl. No.: 17/532,514

(22) Filed: Nov. 22, 2021

(65) Prior Publication Data

US 2022/0202269 A1 Jun. 30, 2022

Related U.S. Application Data

(60) Provisional application No. 63/116,606, filed on Nov. 20, 2020.

(51) Int. Cl.
*A47L 13/19* (2006.01)

(52) U.S. Cl.
CPC ..... *A47L 13/19* (2013.01)

(58) Field of Classification Search
CPC ..... A47L 13/16; A47L 13/17; A47L 13/18; A47L 13/19
USPC ..... 401/7, 8
See application file for complete search history.

(56) References Cited

U.S. PATENT DOCUMENTS

| | | | | |
|---|---|---|---|---|
| 2,795,806 | A * | 6/1957 | Suttles | A47L 13/19 401/270 |
| 3,608,708 | A | 9/1971 | Storandt | |
| 5,979,007 | A | 11/1999 | Soon | |
| 6,305,044 | B1 | 10/2001 | James | |
| 8,813,302 | B1 * | 8/2014 | Capito | A47L 13/18 2/160 |
| 2012/0189371 | A1 * | 7/2012 | Morelli | A47L 1/08 401/7 |
| 2016/0262591 | A1 | 9/2016 | Smalls | |

* cited by examiner

*Primary Examiner* — David J Walczak

(57) ABSTRACT

A gloved wash mitt apparatus for keeping a mitt in place while maintaining dry hands includes a mitt body having a mitt top side, a mitt bottom side, a mitt left edge, a mitt right edge, a mitt top edge, and an open mitt bottom edge defining a mitt cavity. The mitt body has an outer side to dry dust or wet wash a surface without creating scratches. A glove body is coupled to the mitt body within the mitt cavity. The glove body has a glove palm portion, a plurality of glove finger portions extending from the glove palm portion, a glove wrist portion coupled to the glove palm portion, and an open glove bottom side. A glove perimeter of the glove wrist portion is continuously coupled to a mitt perimeter of the open mitt bottom edge. The glove body is waterproof.

9 Claims, 2 Drawing Sheets

GLOVED WASH MITT APPARATUS

CROSS-REFERENCE TO RELATED APPLICATIONS

I hereby claim the benefit under 35 U.S.C. Section 119(e) of U.S. Provisional application 63/116,606 filed Nov. 20, 2020.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to washing mitt devices and more particularly pertains to a new washing mitt device for keeping a mitt in place while maintaining dry hands.

(2) Description of Related Art Including Information Disclosed Under 37 CFR 1.97 and 1.98

The prior art relates to washing mitt devices. Known devices typically have an open pocket that allows the mitt to spin on the user's hand during use. Devices with a fingered internal pocket to prevent spinning lack a waterproof barrier to keep the user's hand dry and feature a multi-faceted outer layer rather than a continuous mitt.

BRIEF SUMMARY OF THE INVENTION

An embodiment of the disclosure meets the needs presented above by generally comprising a mitt body having a mitt top side, a mitt bottom side, a mitt left edge, a mitt right edge, a mitt top edge, and an open mitt bottom edge defining a mitt cavity. The mitt body has an outer side configured to dry dust or wet wash a surface without creating scratches. A glove body is coupled to the mitt body within the mitt cavity. The glove body has a glove palm portion, a plurality of glove finger portions extending from the glove palm portion, a glove wrist portion coupled to the glove palm portion, and an open glove bottom side. A glove perimeter of the glove wrist portion is continuously coupled to a mitt perimeter of the open mitt bottom edge. The glove body is waterproof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
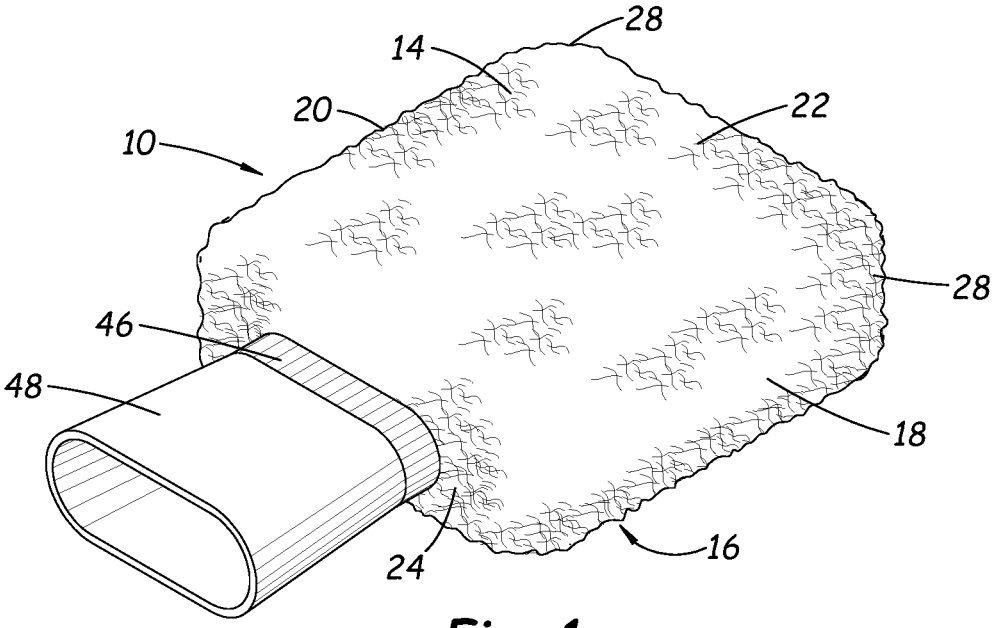
FIG. 1 is an isometric view of a gloved wash mitt apparatus according to an embodiment of the disclosure.
Figure 2:
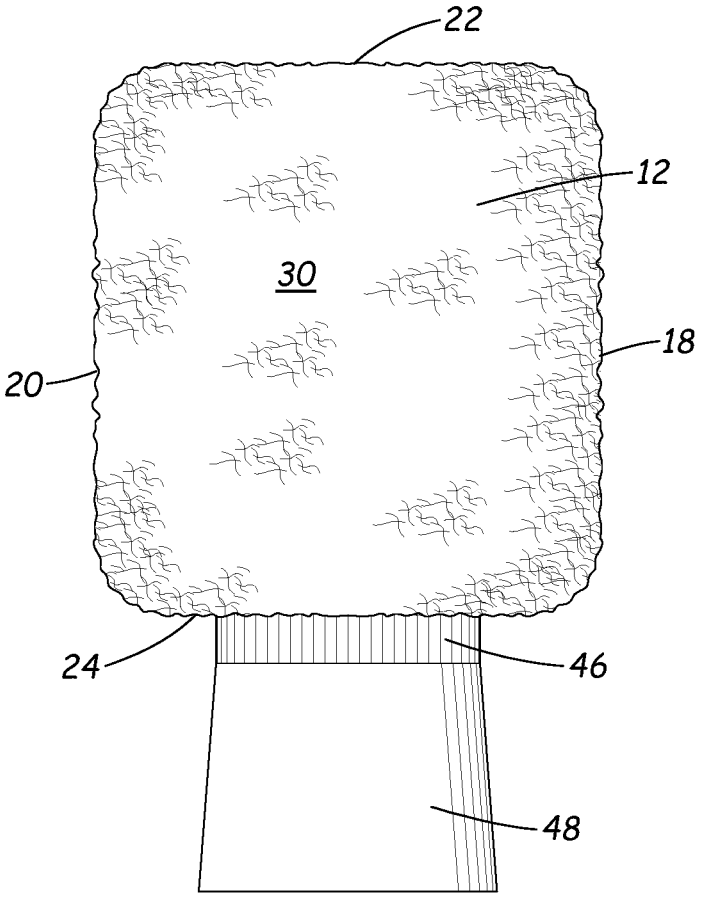
FIG. 2 is a top plan view of an embodiment of the disclosure.
Figure 3:
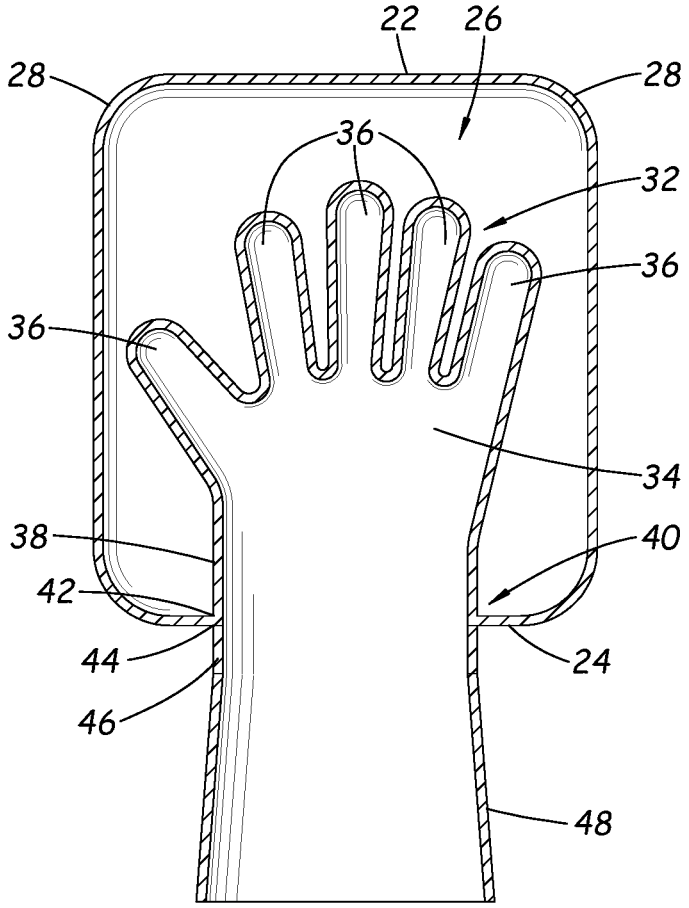
FIG. 3 is a cross-sectional view of an embodiment of the disclosure along the line 3-3 of FIG. 4.
Figure 4:
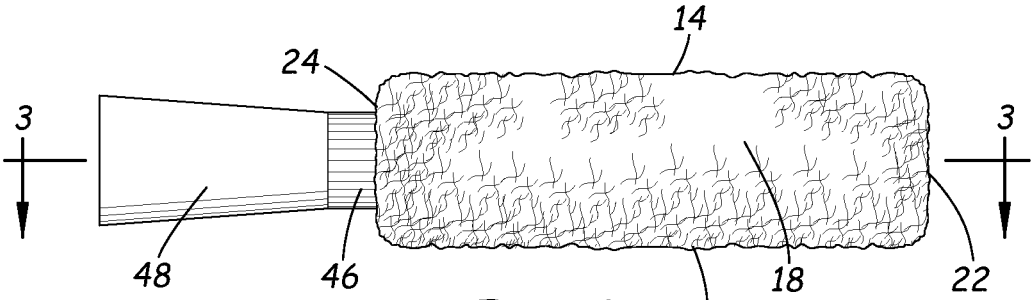
FIG. 4 is a side elevation view of an embodiment of the disclosure.

With reference now to the drawings, and in particular to FIGS. 1 through 4 thereof, a new washing mitt device embodying the principles and concepts of an embodiment of the disclosure and generally designated by the reference numeral 10 will be described.

As best illustrated in FIGS. 1 through 4, the gloved wash mitt apparatus 10 generally comprises a unitary mitt body 12 having a mitt, top side 14, a mitt bottom side 16, a mitt left edge 18, a mitt right edge 20, a mitt top edge 22, and an open mitt bottom edge 24 defining a mitt cavity 26. The mitt body 12 may be substantially rectangular with rounded corners 28. The mitt body 12 has a micro fibrous outer side 30 configured to dry dust or wet wash a surface without creating scratches. The mitt top side 14 and the mitt bottom side 16 each being planar and parallel to each other.

A glove body 32 is coupled to the mitt body 12 within the mitt cavity 26. The glove body 32 has a glove palm portion 34, a plurality of glove finger portions 36 extending from the glove palm portion 34, a glove wrist portion 38 coupled to the glove palm portion 34, and an open glove bottom side 40. The plurality of glove finger portions 36 may receive the user's hand in either direction to allow for ambidextrous use as well as to allow use of both the mitt top side 14 and the mitt bottom side 16 on the same hand. The micro fibrous outer side 30 is continuous extending around the glove body.

A glove perimeter 42 of the glove wrist portion 38 is continuously coupled to a mitt perimeter 44 of the open mitt bottom edge 24. The glove body 32 is waterproof to keep the user's hand entirely dry during washing. A wristband 46 is coupled to the mitt body 12. The wristband 46 is elasticized and coupled to the mitt perimeter 44 to compress against the user's wrist and secure the user's hand within the glove body 32 and the mitt body 12. The wristband 46 may have a micro fibrous wristband outer layer. A sleeve 48 is coupled to the wristband 46 and extends away from the glove body 32 and the mitt body 12. The sleeve 48 covers the forearm of the user. The mitt body 12 may be square shaped or elongated extending away from the wristband 46.

In use, the glove body 32 is worn on either hand to allow the user to clean with the mitt body 12 while maintaining his or her hand completely dry.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gloved wash mitt apparatus comprising:

a unitary mitt body having a mitt top side, a mitt bottom side, a mitt left edge, a mitt right edge, a mitt top edge, and an open mitt bottom edge defining a min cavity, the mitt body having a micro fibrous outer side configured to dry dust or wet wash a surface without creating scratches;

a glove body coupled to the mitt body, the glove body being coupled within the mitt cavity, the glove body having a glove palm portion, a plurality of glove finger portions extending from the glove palm portion, a glove wrist portion coupled to the glove palm portion, and an open glove bottom side, a glove perimeter of the glove wrist portion being continuously coupled to a mitt perimeter of the open mitt bottom edge, the micro fibrous outer side being continuous extending around the glove body; and a wristband coupled to the mitt body, the wristband being elasticized and coupled to the mitt perimeter to compress the user's wrist and secure the user's hand within the glove body and the mitt body.

2. The gloved wash mitt apparatus of claim 1, further comprising a sleeve, the sleeve being coupled to the wristband and extending away from the glove body and mitt body wherein the sleeve is configured to cover a forearm of the user.

3. The gloved wash mitt apparatus of claim 1, wherein the glove body is waterproof.

4. The gloved wash mitt apparatus of claim 1, wherein the mitt body is square.

5. The gloved wash mitt apparatus of claim 1, wherein the is elongated extending away from the wristband.

6. The gloved wash mitt apparatus of claim 1, further comprising the mitt top side and the mitt bottom side each being planar and parallel to each other.

7. A gloved wash mitt apparatus comprising:

a unitary mitt body having a mitt top side, a mitt bottom side, a mitt left edge, a min right edge, a mitt top edge, and an open min bottom edge defining a mitt cavity, the mitt body having a micro fibrous outer side configured to dry dust or wet wash a surface without creating scratches, the mitt top side and the mitt bottom side each being planar and parallel to each other;

a glove body coupled to the mitt body, the glove body being coupled within the mitt cavity, the glove body having a glove palm portion, a plurality of glove finger portions extending from the glove palm portion, a glove wrist portion coupled to the glove palm portion, and an open glove bottom side, a glove perimeter of the glove wrist portion being continuously coupled to a mitt perimeter of the open mitt bottom edge, the glove body being waterproof, the micro fibrous outer side being continuous extending around the glove body;

a wristband coupled to the mitt body, the wristband being elasticized and coupled to the mitt perimeter to compress the user's wrist and secure the user's hand within the glove body and the mitt body; and a sleeve, the sleeve being coupled to the wristband and extending away from the glove body and mitt body wherein the sleeve is configured to cover a forearm of the user.

8. The gloved wash mitt apparatus of claim 7, wherein the mitt body is square.

9. The gloved wash mitt apparatus of claim 7, wherein the mitt body is elongated extending away from the wristband.

* * * * *